US010186770B2

(12) United States Patent
Gears et al.

(10) Patent No.: US 10,186,770 B2
(45) Date of Patent: Jan. 22, 2019

(54) FLEXIBLE DISTRIBUTED ANTENNA SYSTEM USING A WIDEBAND ANTENNA DEVICE

(71) Applicant: ZinWave Limited, Cambridge (GB)

(72) Inventors: Trevor Gears, Standlake (GB); Zafer Boz, Harston (GB); Graham Ronald Howe, Caddington (GB); Emiliano Mezzarobba, Cambridge (GB); Benedict Russell Freeman, Cambridge (GB); Andrew Robert Bell, Hungerford (GB)

(73) Assignee: Zinwave Limited, Cambridge (GB)

( * ) Notice: Subject to any disclaimer, the term of this patent is extended or adjusted under 35 U.S.C. 154(b) by 0 days.

(21) Appl. No.: 15/920,106

(22) Filed: Mar. 13, 2018

(65) Prior Publication Data

US 2018/0219284 A1 Aug. 2, 2018

Related U.S. Application Data

(63) Continuation of application No. 12/864,846, filed as application No. PCT/GB2009/000404 on Feb. 12, 2009, now Pat. No. 9,960,487.

(30) Foreign Application Priority Data

Feb. 14, 2008 (GB) ..... 0802760.9
Aug. 5, 2008 (GB) ..... 0814363.8

(51) Int. Cl.
*H01Q 21/00* (2006.01)
*H01Q 1/52* (2006.01)
*H01Q 1/24* (2006.01)

(52) U.S. Cl.
CPC ..... *H01Q 1/525* (2013.01); *H01Q 1/246* (2013.01)

(58) Field of Classification Search
CPC ..... H01Q 1/525; H01Q 1/246
See application file for complete search history.

(56) References Cited

U.S. PATENT DOCUMENTS 4,347,625 A * 8/1982 Williams ..... H04W 84/08 340/7.25
5,210,407 A * 5/1993 Ito ..... G01R 29/0885 250/227.11

(Continued)

FOREIGN PATENT DOCUMENTS

EP 1049195 A2 * 11/2000 ..... H01Q 1/246
GB 2390225 A 12/2003

(Continued)

OTHER PUBLICATIONS

International Search Report for PCT Application No. PCT/GB2009/000404, dated Jul. 14, 2009, 6 pages.

(Continued)

*Primary Examiner* — Graham Smith
*Assistant Examiner* — Jae Kim
(74) *Attorney, Agent, or Firm* — Maynard Cooper & Gale, P.C.; Brian Sattizahn

(57) ABSTRACT

A distributed antenna system (DAS) includes a wideband antenna device having respective transmit and receive antennas disposed in a single package and arranged to provide mutual isolation so that in use noise from the transmit antenna is isolated from the receive antenna, whereby reception is possible at the same frequency as transmission.

31 Claims, 4 Drawing Sheets

(56) References Cited

U.S. PATENT DOCUMENTS

| | | | | |
|---|---|---|---|---|
| 6,069,587 | A | 5/2000 | Lynch et al. | |
| 6,624,789 | B1 | 9/2003 | Kangasvieri et al. | |
| 6,868,236 | B2 * | 3/2005 | Wiltsey | G02B 6/2804 398/118 |
| 6,882,771 | B1 * | 4/2005 | Islam | G02B 6/3516 385/18 |
| 7,280,848 | B2 | 10/2007 | Hoppenstein | |
| 2001/0015706 | A1 | 8/2001 | Judd | |
| 2002/0191565 | A1 | 12/2002 | Mani et al. | |
| 2004/0142700 | A1 | 7/2004 | Marinier | |
| 2005/0242992 | A1 | 11/2005 | Tomasic et al. | |
| 2006/0055611 | A1 * | 3/2006 | Karaoguz | H01Q 1/1257 343/757 |
| 2007/0022460 | A1 | 1/2007 | Kim et al. | |
| 2007/0080888 | A1 * | 4/2007 | Mohamadi | H01Q 21/0025 343/853 |
| 2007/0133995 | A1 | 6/2007 | Lee et al. | |
| 2008/0058018 | A1 | 3/2008 | Scheinert | |

FOREIGN PATENT DOCUMENTS

| | | | |
|---|---|---|---|
| WO | 2000/51201 | A1 | 8/2000 |
| WO | 2006/018711 | A1 | 2/2006 |

OTHER PUBLICATIONS

Written Opinion for PCT Application No. PCT/GB2009/000404, dated Jul. 14, 2009, 9 pages.

* cited by examiner

FLEXIBLE DISTRIBUTED ANTENNA SYSTEM USING A WIDEBAND ANTENNA DEVICE

CROSS-REFERENCE TO RELATED APPLICATIONS

This application is a continuation of U.S. application Ser. No. 12/864,846, filed Nov. 19, 2010 and entitled "Flexible Distributed Antenna System Using a Wideband Antenna Device," which was the National Stage of International Application No. PCT/GB2009/000404, filed Feb. 12, 2009 and entitled "Communication System," which claims priority to Great Britain Application No. 0802760.9, filed Feb. 14, 2008 and entitled "Antenna Device," and Great Britain Application No. 0814363.8, filed Aug. 5, 2008 and entitled "Signal Transmission System," all of which applications are hereby incorporated by reference in their entirety.

BACKGROUND

The present invention relates generally to the field of communication. More specific but non-limiting aspects of the invention concern a wideband two-way antenna device, a distributed antenna system and method of operating such a system, in which signals carrying information are conveyed. Embodiments operate to transmit and receive signals modulated onto an RF carrier without frequency-changing.

The term "wideband" in this patent application means that all frequencies within a given pass band are available for both transmission and reception of signals.

Distributed antenna systems are well-known. Some known systems use frequency down-conversion in order to obtain sufficient transmission quality over a given length of transmission medium; others have in-built frequency determination, for example provided by filtering, or by narrowband amplifiers.

It is a feature of state of the art distributed antenna systems that where a user desires to increase the number of services to be carried, or to add input signals of a new frequency range, additional costs arise. It is a feature of state of the art distributed antenna systems that amplifiers and other components dedicated to the services to be carried, for example, having a narrow transmission band for a particular service, are required. This means that an installer must stock a large variety of different such components if he is to provide an off-the-peg service. It also makes maintenance difficult.

One challenge for embodiments is to enable a flexible distributed antenna system to be created.

In one aspect there is provided a wideband antenna device having respective transmit and receive antennas disposed in a single package and arranged to provide mutual isolation so that in use noise from the transmit antenna is isolated from the transmit antenna, whereby reception is possible at a frequency the same as transmission.

The antennas may be disposed in close mutual physical proximity.

The antennas may be separated by less than twice the wavelength of the lowest frequency.

The antenna may have stubs disposed generally between the antennas for increasing electrical isolation therebetween.

The stubs may comprise stubs having a dimension of about a quarter of a wavelength of a lowest transmit/receive frequency.

The stubs may comprise stubs arranged to provide isolation around a mid band frequency and around a highest frequency of said wideband.

In another aspect, there is provided a distributed antenna system having a hub, at least one remote antenna device having an associated transmit antenna and an associated receive antenna, a downlink providing a path for signals from the hub to the transmit antenna and an uplink providing a path for signals from the receive antenna to the hub, wherein the system is adapted to be able simultaneously to convey a plurality of different communication services.

The system may be configured to be able simultaneously to carry the following services over a single uplink and a single downlink: Tetra; EGSM900; DCS1800; UMTS; WLAN and WiMax.

In a further aspect there is provided a distributed antenna system having a hub, at least one remote antenna device having an associated transmit antenna and an associated receive antenna, a downlink providing a path for signals from the hub to the transmit antenna and an uplink providing a path for signals from the receive antenna to the hub, wherein each of the uplink and downlink has a compensation device having plural selectable frequency-gain characteristics for providing compensation for frequency-dependent loss in the respective link.

The transmit and receive antennas may be provided in a single module.

The uplink and the downlink may each be adapted to carry signals having frequencies that range between 130 MHz and 2.7 GHz.

In some embodiments, the uplink and the downlink are provided by multimode fibres.

In certain embodiments, light is launched into the respective fibres so as to provide a restricted number of modes, and preferably, to eliminate lowest order modes and higher order modes.

In other embodiments, the uplink and downlink are provided by one or more of single mode fibres and conductive links such as coaxial cables.

In a still further aspect, there is provided a distributed antenna system having a hub, at least one remote antenna device having an associated transmission antenna and an associated reception antenna, a downlink providing a path for transmission signals from the hub to the transmission antenna and an uplink providing a path for reception signals from the reception antenna to the hub, wherein the system is adapted to be able simultaneously to convey transmission and reception signals of identical frequency.

The system may have a filter for extracting command signals from the downlink for controlling the remote antenna device.

The remote antenna device may comprise a control device connected to receive signals from the filter, and having an output for controlling components of the remote antenna device.

The system may have a wideband power amplification means for driving the transmission antenna, the amplification means being responsive to transmission signals of any frequency between the upper and lower frequency bounds carried by the downlink.

The system may have a low-noise amplification means coupled to the reception antenna, the low-noise amplification means being responsive to reception signals of any frequency carried by the uplink.

In a yet further aspect, there is provided a distributed antenna system having an input/output arranged to allow signals from one or more external transmission or signal supply networks to be input, carried by the system and transferred via an antenna of the system to a consumer, and arranged to allow a return path from a consumer to the external network, wherein signal transfer within the system uses a downlink linking the input/output to the antenna, and wherein the signals transferred through the downlink correspond in frequency to that of input/output signals at the input/output.

In still another aspect there is provided a method of operating a distributed antenna system, the method comprising responding to an electric signal having a predetermined carrier frequency by conveying a corresponding signal of that carrier frequency over a broadband link to an antenna, and radiating a signal of that frequency from the antenna.

The link may be adapted to carry signals across the band extending from 170 MHz to 2.7 GHz.

One embodiment provides a distributed antenna system in which optical transmission over fibre is used, wherein the system is broadband in that any signal whose frequency is within the upper and lower limits of the system will be transferred. Moreover, different signals having frequencies within those limits may be carried.

DAS systems allow for two-way signal transfer, and as a consequence the broadband ability makes it possible for signal reception to occur at a frequency at which signal transmission is taking place, and at the same time as such transmission is occurring. This places constraints on the antenna(s), and can also affect other parts of the system.

Thus to be able to simultaneously transmit and receive over the full wideband frequency range, two antennas are used, one for transmit and one for receive.

In certain systems, for example active wideband distributed antenna systems, greater than a minimum isolation is maintained between the two antennas; otherwise the system can become unstable and oscillate as a result of the transmit signal entering the receive antenna.

Equally, a transmit antenna will, in use, be transmitting broad band noise which is likely to include the same frequency as the receive channel of the services being carried. Thus noise from the system, radiating from the transmit antenna, must be isolated from the receive antenna, otherwise the receiver channels will become desensitised. An embodiment of an antenna useable in the invention aims to provide isolation of approx. 40 dB. Another aims to provide isolation of 45 dB.

Some exemplary embodiments of the system have a frequency range of approx. 170 MHz to 2700 MHz, this range being the range of frequencies over which the gain (25±5 dB) and the necessary linearity to achieve CE & FCC certification specs are met.

In another aspect, a distributed antenna system has an input/output arranged to allow signals from one or more external transmission or signal supply networks to be input, carried by the system and transferred via an antenna of the system to a consumer, and arranged to allow a return path from a consumer to the external network, wherein signal transfer within the system uses one or more optical fibres linking the input/output to the or each antenna, and wherein the signals transferred through the or each fibre correspond in frequency to that of input/output signals at the input/output.

In some embodiments, no frequency conversions are provided. In some embodiments, any RF signals within the frequency range of the system are passed through transparently, since no filtering within the frequency range of the system is provided.

Some embodiments have an advantage that the embodiment is not bandwidth restricted in that as long as additional/future services fall within the frequency bounds of the system itself, any number of additional services can be carried by the DAS.

In some embodiments, both TDD and FDD services can be carried. Narrow band systems cannot carry TDD services as they rely on the fact that transmit and receive frequencies are different and combined with a Duplex filter at the input/output.

Some embodiments of the system can provide economic benefits, as with such embodiments. The cost is not directly related to the number of services being carried. With narrow band DAS, additional services usually require additional equipment so the cost rises with number of services.

In embodiments of the antenna device, so as to be able to simultaneously transmit and receive over the full broadband frequency range, two antennas are used, one for transmit and one for receive.

In certain systems, for example, active broadband distributed antenna systems, greater than a minimum isolation is maintained between the two antennas; otherwise the system can become unstable and oscillate as a result of the transmit signal entering the receive antenna.

This isolation could be achieved by using two patch antennas spaced physically apart, e.g., 1 m to 2 m, and aligned such that the gain response of each antenna is at a null in the direction of the other antenna. However, this approach has several disadvantages. It will not work for omni-directional antennas, which are preferred by the industry for their ease of installation and good coverage of large open areas, for example rooms. It requires careful antenna alignment and therefore places a high requirement on the technical skills of the installers, which is commercially undesirable. It takes up a large amount of physical space at installation and is visually unappealing.

A solution to the isolation problem is to use a high-isolation dual-port broadband antenna module.

An embodiment offers a single module, containing two antennas, where the isolation between the antennas is maintained as part of the design and not as a result of the installation. The single module is much more attractive to the industry as it only requires one module to be installed and is therefore cheaper to install and less visually intrusive.

Embodiments of the invention will now be described, by way of example only, with reference to the appended figures, in which.

Figure 1:
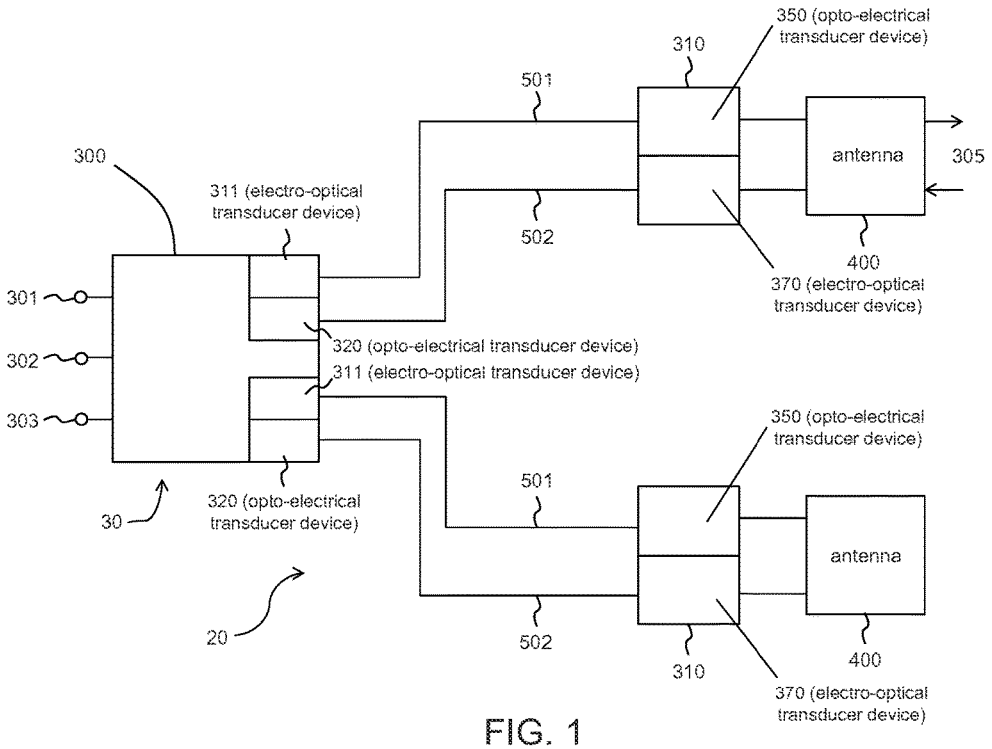
FIG. 1 shows a schematic drawing of an embodiment of a distributed antenna system.

Three significant components of a broadband DAS system are the distribution components within the DAS, the remote unit of the DAS and the antenna for the remote unit.

1. Distribution components: A broadband signal distribution system including transmission media having low loss, distortion and cross talk between uplink and downlink directions.
2. Remote unit: The transmission medium, in the uplink direction feeds to a remotely located electronic unit, hereinafter remote unit, that may, if the transmission media carries optical signals, convert optical broadband to electrical RF broadband signals. The remote unit provides highly linear amplification to a sufficient power level for economic coverage.

3. Antenna: Electrical signals of the remote unit are fed to a transmit antenna. This is associated with an receive antenna that permits a consumer in range of the transmit and receive antennas to two-way communicate over the system. In a commercially and technically desirable arrangement, both transmit and receive antennas are disposed within a single, compact housing.

In the following family of embodiments of the distributed antenna system and method of operating such a system, the system is wholly transparent to signals within its frequency bounds. That is to say, the system itself operates to transfer in both the uplink or downlink direction signals of any type or frequency that fall within the system pass range. In these embodiments, there are no frequency conversions and no filtering within the frequency range of the system.

One embodiment makes use of the fact that a multimode fibre can be operated to carry light directly representative of signals modulated onto carrier signals where the frequency-distance product is well beyond the specification of the fibre itself. To that end, the embodiment allows one or more distinct services to be implemented in both an uplink and downlink direction without the need to down-convert before launching into the fibre.

It will of course be clear that the use of a system that is transparent to signals does not prevent signals being carried where a signal control regime imposes constraints on the signals carried. In other words, the use of a transparent communication system does not conflict with, for example, the carrying of signals in which uplinks and downlinks do have a defined frequency relationship.

The architecture of this family of embodiments has several advantages:

The system is not bandwidth-restricted. As long as additional/future services fall within the current frequency range, any such services can be carried by the DAS.

Both TDD and FDD services can be carried. Narrow band systems cannot carry TDD services where they rely on the fact that transmit and receive frequencies are different and combined with a Duplex filter at the input/output.

Economics, i.e., the cost, is not directly proportional to the number of services being carried. With narrow band DAS, additional services require additional equipment so the cost rises with number of services.

Referring initially to FIG. 1, an embodiment of a DAS using optical fibres for transfer of signals has a distribution system having a signal hub 300 connected to receive signals 301-303 from, for example, mobile phone base stations 301, wired Internet 302, wired LANs 303 and the like, for transfer to distributed antennas 400 having remote units 310 via transmit multimode fibres 501. The hub 300 is also connected to receive signals 305 that enter the DAS 20 at the antennas 400, and are transferred to the hub 300 via receive multimode fibres 502 and the remote units 310. In this embodiment, the fibres 501, 502 are mutually substantially identical.

The embodiment is designed to allow the transfer of, for example the following services:

| Band | Uplink-lower | Uplink-upper | Downlink-lower | Downlink-upper |
|---|---|---|---|---|
| TETRA | 380 | 450 | 390 | 460 |
| EGSM900 | 880 | 915 | 925 | 960 |

-continued

| Band | Uplink-lower | Uplink-upper | Downlink-lower | Downlink-upper |
|---|---|---|---|---|
| DCS1800 | 1710 | 1785 | 1805 | 1880 |
| UMTS | 1920 | 1980 | 2110 | 2170 |
| WLAN | 2400 | 2470 | 2400 | 2470 |
| WiMAX | ~2500 | ~2700 | ~2500 | ~2700 |

Embodiments using other media, for example, conductive means such as coaxial cables, may have like specifications.

The actual signals will depend on the current transmission state. For example, if no cell phones are being used at any one time, the system will not be carrying such signals. However, it has the capability of doing so when required.

Figure 2:
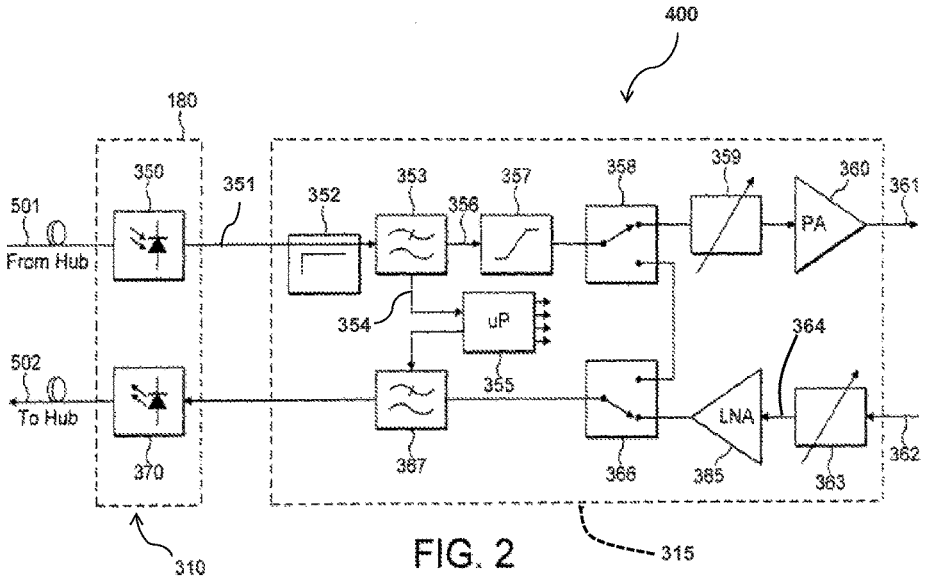
FIG. 2 shows an embodiment of a remote unit.

Referring to FIG. 2, electro-optical transduction devices 311, 370 respectively at hub 300 and in the remote units 310 create in the fibres 501, 502 optical signals that are the optical analogues of the 3G signals. No frequency conversion is applied. Opto-electrical transduction devices 350, 320 receive the optical signals from the respective fibres 501, 502, and provide electrical signals analogous to the optical signals. The electrical signals are fed to the hub 300, in the receive direction, and to the antennas 400 in the transmit direction, again without frequency conversion.

The transducer devices 311, 370; 350, 320 include RF and optical amplification stages that have high linearity across the frequency range of the DAS so as to be able to pass multiple carriers over a wide frequency range without non-linearities causing interference.

In this embodiment:

Intermediate chain amplifiers (i.e., in the hub and module RF path) have a wide bandwidth (3 dB gain bandwidth 2.7 GHz) and a higher linearity (average OIP2 of 50 dBm). OIP2 is the theoretical output level at which the second-order two-tone distortion products are equal in power to the desired signals.

A linear DFB laser achieves an OIP2 of 30 dBm when using a factory-calibrated input bias current rather than a fixed value.

A filter in the remote unit attenuates $2^{nd}$ order components above 2.7 GHz (i.e., those coming from carrier signals above 1.35 GHz). This allows the amplifier performance above 1.35 GHz to be $3^{rd}$ order limited rather than $2^{nd}$ order limited ($3^{rd}$ order limits typically allow a 6 dB lower back-off than $2^{nd}$ order limits).

The power amplifier pre-driver has an average OIP2 of 60 dBm below 1.35 GHz.

The power amplifier is a twin transistor high-linearity design which achieves an OIP2 of 70 dBm.

As is well-known, multimode fibres are specified by a frequency-length product "bandwidth" parameter, usually for an over-filled launch (OFL). Transmission may be carried out in improved fashion, improving on the apparent limitation shown by this parameter by using, instead of an overfilled launch, a restricted-mode launch, intended to avoid high-order modes. In this way, baseband digital signals can be carried at higher repetition rates or for longer distances than the bandwidth parameter predicts. The present inventors have also discovered that there is a useable performance region that extends above the accepted frequency limit which may be accessed by a correct choice of excitation modes. This region, if launch conditions are correct, can be generally without zeroes or lossy regions.

Launch may be either axis-parallel but offset, angularly offset, or any other launch that provides suppression of low and high order modes. For certain multimode fibres, a centre launch works. In one installation technique for mmf, a centre launch is used as an initial attempt then changing to offset launch if there are critical gain nulls.

In an embodiment of the remote unit 310, starting with the uplink path, there is an optical module 180 that consists of a photodiode 350, with optical connectors for the downlink fibre 501, and electronics (not shown) for transduction of the optical signal to a desired electrical signal, and a laser 370 having a launch to enable connection of the uplink fibre 502, together with the necessary drive electronics (not shown) for the laser.

The photodiode 350 is coupled to receive light from the incoming fibre 501 and provides an electrical output at a node 351. Signals at the electrical node 351 correspond directly to variations in the light on the fibre 501. The electrical node 351 forms an input to the electronics 315 of the remote unit. The electronics 315 has a power detector 352 whose output connects to a filter 353 having a low pass output 354 to a digital controller 355. A high pass output 356 of the filter 353 feeds to a slope compensator 357, and the output of the slope compensator 357 feeds via a switch 358 and a controllable attenuator 359 to a high linearity power amplifier 360 (with no filtering within the wideband of operation) having an output 361 for driving the transmit antenna (not shown).

Controllable attenuator 359 allows for different optical link lengths and types with different amounts of loss together with output level control. This is used in conjunction with the slope compensator 357, which flattens the gain profile of these different optical links as described below. 363 is another variable attenuator that is used for varying the system sensitivity (zero attenuation=high sensitivity but more susceptible to interference, high attenuation=low sensitivity but high interference protection).

In some embodiments there is also an AGC detector (not shown) which allows it to be used for adaptive interference protection. This is useful in a wideband system where they may be many uplink radio sources in a building that are in-band for the DAS but not relevant to the connected base-stations or repeaters.

The power detector 352 on the uplink from the hub is used to measure fibre loss from the hub to the remote unit. The filter 353 allows extraction of and insertion of a low frequency, out of band, communications channel that allows the hub and remote unit to communicate.

In the downlink side of this embodiment, an input 362 from the receive antenna provides RF signals to the input of a controllable attenuator 363. The attenuator has an output node 364 coupled to a low noise amplifier 365, and this in turn has an output coupled via a switch 366 to a filter circuit 367. The output of the filter circuit 367 is connected via suitable drive circuitry (not shown) to a laser 370, here a DFB laser. The optical output of the laser 370 is connected to launch light into the uplink fibre 502.

Signals from the controller 355 may be conveyed via the filter 367 and the uplink fibre 502 back to the hub.

Each fibre run has an absolute loss, which will vary by medium and length as well as a gain slope with frequency, such that higher frequencies (e.g., 2.7 GHz) are attenuated more than lower frequencies (e.g., 200 MHz). The gain slope can be as much as 18 dB across the band of operation. In coax-type embodiments, the gain slope may be up to 23 dB. It is desirable to achieve an approximately flat frequency response between the hub and all remote units, otherwise accurately controlling the absolute and relative power levels of services at different frequencies and different remote units becomes impossible (as once services are combined, they cannot be un-combined and level shifted in a broadband RF system). Thus each interconnection is slope and gain compensated, so that the relative power levels of all services are independent of length and cable type. This is achieved by the slope compensator 357, and a counterpart slope compensator for the uplink path. In the embodiment, the compensators each have plural selectable frequency versus gain characteristics programmed into them, so that the controller 355 may select a characteristic that substantially compensates for the characteristics of the fibre concerned.

The characteristic is selected during a set-up procedure. In an example of this, a signal generator in a hub connected to the fibres 501, 502 is controlled to provide a signal at a desired first in-band frequency at a given power level to the downlink fibre 501, and thence to the power detector 352. The detected power level is transferred to the controller 355. Then a different second in-band frequency is output over the downlink fibre 501, and the relevant power detected, and the value supplied to the controller 355. This is repeated over different frequencies to obtain information on the frequency characteristics of the fibre 501. The controller 355 in this embodiment sends back the information on power levels over the uplink fibre 502 to the hub, where the selection of the best-fit compensation characteristic is made. Then a command signal is sent out over downlink fibre 501, this being passed to the controller 355, which has outputs for commanding the compensator 357 to select the relevant best-fit curve.

By use of the loop-back switches, the signal generator in the hub can then be used to compensate for the frequency characteristics of the uplink fibre in a like fashion. In other embodiments, the controller 355 is programmed to set the characteristics of the associated compensator 357 based upon the measurements it makes, without further commands from the hub. In other embodiments, a signal generator may be provided in the remote unit as well as in the hub. Alternatively a signal generator may be temporarily connected as required as part of a commissioning process.

In this embodiment, the fibre is a multimode fibre, and the laser 370 is coupled to it via a single mode patch cord to provide coaxial but spatially offset launch of light into the fibre 502.

The switch 358 on the uplink, together with the switch 366 on the downlink side provides loop-back functionality to allow signals from the hub to be switched back to the hub to allow the hub to perform an RF loop-back measurement. This is from the hub to the remote unit back to the hub to measure cable/fibre loss over frequency.

The controllable attenuator 359 in the downlink path, and the controllable attenuator 363 in the uplink path allow respectively for output power control and input signal level control. Two slope compensator modules are required in the system per remote unit. In this embodiment the one 357 in the uplink path is provided at the RU 311 and that 363 in the downlink path is provided in the hub. They are operated to compensate for frequency-dependent loss in the transmission channel, typically in the fibre 501.

The antenna typically consists of active elements and passive elements. The active elements are the antennas, and have conductive connections for signals. The passive elements are not conductively connected to allow signal input or output, and are referred to hereinafter as "stubs".

Figure 3:
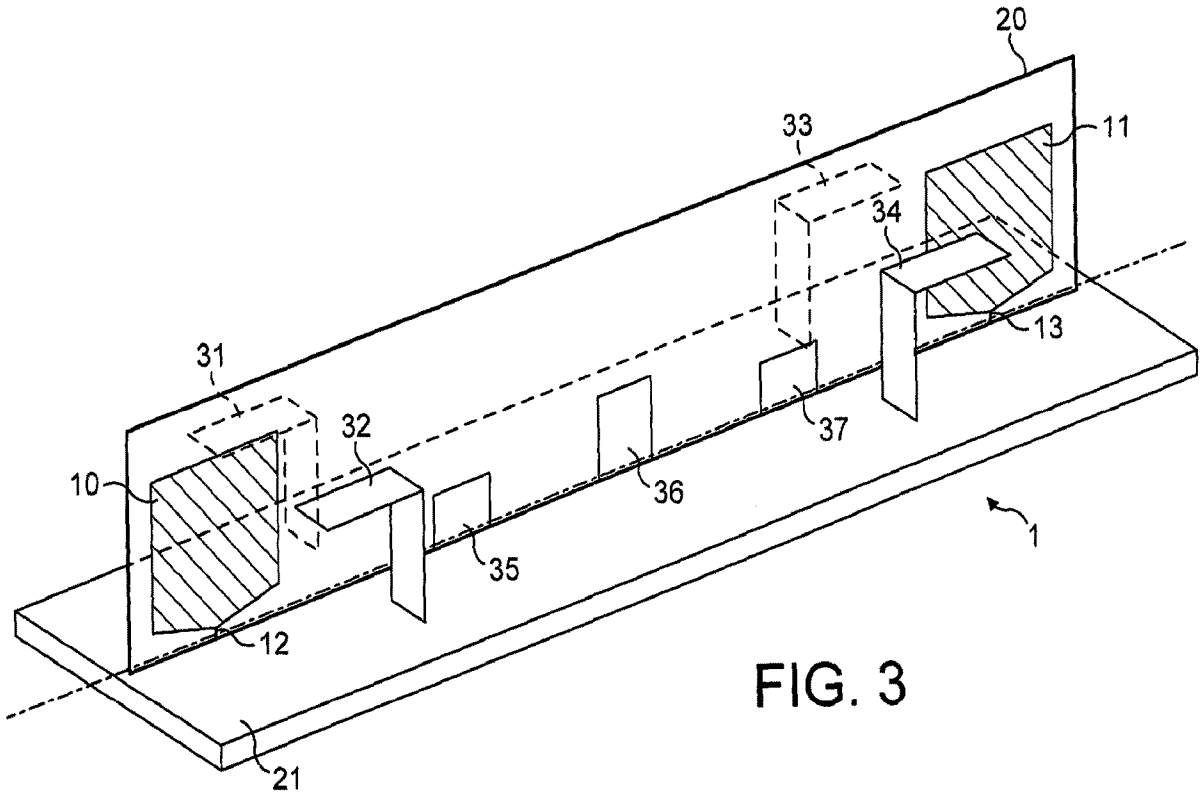
FIG. 3 shows a perspective view of a first embodiment of an antenna module.

Referring to FIG. 3, a first embodiment of the antenna module 1 has two wide-band printed monopole antennas 10, 11 each on a single printed circuit board 20. The PCB 20 stands up orthogonally to a common ground plane 21. The ground plane has a width dimension and a length dimension, with the length dimension in this embodiment being larger than the width dimension. The antenna arrangement is arranged to provide the required isolation, typically 40 dB across the frequency range of the system. This embodiment provides a single PCB solution, packaged as a single antenna module, in which the isolation is inherent in the design rather than the positioning of the antenna.

In this embodiment, the antenna module is remote from the electronics which drives it. In another it is integral with a broadband power transmission amplifier and low-noise receiving amplifier, thus minimising the complexity of installation.

The two broadband printed monopole antennas 10, 11 of this embodiment are laterally spaced apart and aligned in a common plane. In the present embodiment the two antennas 10, 11 are like generally rectangular patches, each having a first respective side defining a height dimension, extending in the direction perpendicular to the ground plane 21, similar to the antenna width dimension, defined by a second respective side perpendicular to the first and extending in the direction along the PCB corresponding to the long dimension of the ground plane 21. In other embodiments each antenna can be constructed as a rod, strip or patch.

The height dimension in electrical terms is typically a quarter wavelength at the lowest operational frequency. In this embodiment, the height of the patches 10, 11 is physically shorter than this value due to its area (periphery around the element) and the fact that it is bounded by and, in this case bonded to, a dielectric with a dielectric constant of approx. 4.5 of the board 20.

The antennas 10, 11 are separated by less than 2λ. Electrical connection is via respective insulating feed-throughs 12, 13.

Each monopole has a respective pair of first stubs 31, 32; 33, 34 placed nearby and supplementary stubs 35, 36, 37 positioned between the monopoles. The stubs are earthed to the ground plane 21, and extend from it. Each stub 31-37 has at least a first proximal portion that extends generally parallel to the height dimension. In this embodiment, the first stubs 31-34 have a generally inverted "L" shape, with a distal portion extending from a remote end of the proximal portion generally parallel to the length dimension of the ground plane 21. In this embodiment, the first stubs 31-34 are not bounded by dielectric, and they are relatively narrow. Hence their physical length for an electrical length of approximately a quarter wavelength is greater than the height of the patches. The first stubs are disposed in pairs 31, 32; 33, 34 on each side of the printed circuit board 20 longitudinally between the patch antennas 10, 11 and spaced in the length dimension of the ground plane 21 by an amount equal approximately to the length of the distal portions of the stubs, the arrangement being such that the end of distal portions is approximately aligned with the edge of the respective patch antenna 10, 11.

In some embodiments, including the present embodiment, it is desirable to keep the overall dimensions of the antenna module as small as possible, largely for aesthetic reasons, but also to ensure that it can be used in the greatest possible range of locations. However, there is a limiting factor in smallness, caused by the length in the height dimension of the first stubs 31-34, and the fact that they are not disposed on the central axis of the antenna module. The length of the proximal and distal portions is approximately λ/4, where λ is the wavelength of the lowest frequency band, for example 850-950 MHz.

To achieve this length, as has already been discussed, the elements are folded horizontal over a portion of their length. The vertical/horizontal ratio is to some extent arbitrary. In the present case, it is selected to snugly fit within the profile of a radome that houses the antenna module. However, folding the stub element is not without its downsides since the horizontal portion adds capacitance to the stub due to proximity between the horizontal (distal) portion and ground plane 21. The extra capacitance has an impact on the total physical length of the passive element.

The selection of the location of the first stubs 31-34 is important, since it gives rise to a good cancellation of direct coupling between the antennas. Selection of the location can be achieved by trial and error as it may depend on a number of effects. For one thing, any change in the electrical lengths of the stubs will lead to a phase change which in turn affects the physical positioning of the passive elements. In the described embodiments, the first stubs 31-34 are mutually identical in dimensions. Different length stubs could be chosen, but this would change their physical positioning to arrive at the same cancellation profile.

The first stubs, as shown, all turn outwardly, i.e., their distal portions are directed away from the centre region of the earth plane. However, it would also alternatively be possible for some or all to be turned inwards so that the distal portions face each other. Each orientation has a different phase effect and requires different positioning of the first stubs.

The described embodiment has first stubs 31-34 folded outward, which has the advantage of lowering the frequency performance of the patch antennas 10,11 and gives more control over the power coupled to the stubs.

In this embodiment, the further stubs 35-37 are coplanar with the patch antennas 10, 11, and have the form of patches themselves, being disposed on the PCB 20. In this embodiment, the stubs 31, 32; 33, 34; 35; 36; 37 are strips. However, in other embodiments, the stubs may be of any convenient form, for instance rods, or other cross-section. In this embodiment, there is a pair of relatively small rectangular stubs 35, 37, each at around ⅓ of the distance between the proximate edges of the patch antennas 10,11, and having a height around ⅓ of the height of the patch antennas 10,11, and a central rectangular stub 36, having a height of around double that of the small rectangular stubs 35, 37. The length along the length direction of the PCB 20 of each stub is around 1/12 of the spacing between the patch antennas 10,11. The height of the central rectangular stub 36 is approx. half the length of the first stubs 31, 32, 33, 34 and provide isolation, in this embodiment, for a mid frequency range of 1850-1950 MHz. The small rectangular stubs 35, 37 have the same function but for 2.2-2.6 GHz range.

The two patch antennas 10, 11 are spaced close together by virtue of the application and the constraints of the packaging. It is at the lowest frequencies that RF isolation between antennas is at its lowest value. The addition of resonant first stubs 31, 32; 33, 34 at the lowest frequencies provides alternative coupling paths between antennas that cancel the original coupling path, resulting in a higher isolation between antennas. The bandwidth of the cancellation by the first stubs covers the lower range of frequencies.

At the higher frequency bands, the coupled power between the patch antennas 10, 11 decreases due to the increase in the electrical separation between them. For these bands, stubs have much lower size and therefore can be positioned further away from the patch antennas 10, 11. The effects on cancellation levels are much less dramatic than that of the first stubs 31-34. However, they do provide a few dBs extra isolation at the higher frequencies.

At mid-range frequencies, the stubs 31, 32; 33, 34 act as reflectors/directors that provide some isolation. The central further stub 36 is tending towards resonance at these mid-range frequencies to induce isolation between the two antennas 10,11, and some contribution is also made by the small further stubs 35, 37. At these frequencies, isolation has increased due to the apparent increase in electrical separation between antennas.

At high end frequencies, the small further stubs 35, 37 tend towards resonance and their effect is to increase the electrical separation between antennas 10, 11. The first stubs 31, 32; 33, 34 provide the least contribution to overall isolation and the central further stub 36 provides some isolation contribution.

In this embodiment, all of the stubs and further stubs 31-37 are electrically bonded to the conducting ground plane 21. Again, in this embodiment, two first stubs per monopole are used, but other numbers are envisaged.

In this embodiment, the stubs are symmetrically placed—see FIG. 3. However, in other embodiments, asymmetry may provide improved results depending on the desired performance conditions. It may be necessary to vary the stub disposition to achieve the desired isolation, since it has been found that the placement of the stubs plays a significant role in the antenna-to-antenna isolation.

In the described embodiment, the dual antenna module is integral with the remote unit, having the broadband transmit power amplifier and low noise amplifier for receiving signal integrated into the dual antenna modules, thus minimising the complexity of installation, and providing the best noise and matching performance. In other embodiments, the antenna is separate from the remote unit.

In the described embodiment of a distributed antenna system, transfer of signals from hub to remote unit is via multimode fibre. In this embodiment, respective single laser diodes are used for each uplink fibre and each downlink fibre, thereby providing plural services. It is of course possible to use different lasers for each service, or for different groups of service, if desired. In other embodiments, other means of signal transfer are used instead, for example, dual coaxial cable, one for uplink and one for downlink. Alternatively, single mode fibre could be substituted.

The architecture of the described system embodiment, using mmf, is entirely applicable to a single mode fibre embodiment. If the optical module 180, and a corresponding optical module at the hub, are omitted, then conductive links can be used in place of fibres. In one embodiment, an interface module is needed to allow for conductive links to be matched to the conductive links and to carry the required signal levels; however, in other embodiments, direct coupling to the conductive, e.g., coaxial cable, links is possible. Where a coax cable link is provided, it may be used to carry a power supply feed to the remote unit.

Figure 4:
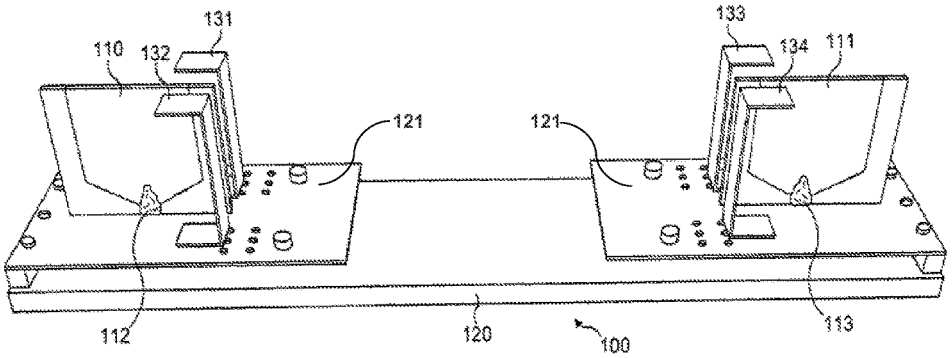
FIG. 4 shows a perspective view of a second embodiment of an antenna module.

Referring to FIG. 4, another embodiment 100 of the antenna module has two wideband printed monopole antennas 110, 111 each on a single PCB 120 arranged, with appropriate chokes, to provide the required isolation across the frequency range of the system. This embodiment provides a single PCB solution, which can be packaged as a single antenna module and where the isolation is inherent in the design rather than the positioning of the antenna module.

The two wideband printed monopole antennas of the described embodiment are aligned parallel to one another in the same plane, and perpendicular to the ground plane 121 of the PCB 120. In the present embodiment each antenna 110, 111 is a like patch; however, in other embodiments, each antenna can be constructed as a rod, strip or patch.

Both antennas have the same orientation; they are mounted onto an electrically common metallic ground plane, and are separated by less than 2λ. Electrical connection is via respective insulating feedthroughs 112, 113.

Each monopole has a respective pair of stubs 131, 132; 133, 134 placed nearby to shape the beam pattern and provide more directionality in the direction away from the other monopole, i.e., increase isolation between the monopoles. In this embodiment, the stubs 131, 132; 133, 134 are strips that have substantially the same height as the patch antennas, however, in others, the stubs may be of any convenient form, for instance rods, or other cross-section.

The two antennas 110, 111 are necessarily spaced close together. It is at the lowest frequencies that RF isolation between antennas is at its lowest value. The addition of stubs 131, 132; 133, 134 resonant at this frequency provides alternative coupling paths between antennas that cancel the original coupling path, resulting in a higher isolation between antennas. The bandwidth of the stub cancellation covers the lower range of frequencies.

At mid-range frequencies, the stubs 131, 132; 133, 134 act as reflectors/directors that provide some isolation due to the resultant directivity of antenna 110, 111 and stubs 131, 132; 133, 134. At these frequencies, isolation has increased due to the apparent increase in electrical separation between antennas.

At high end frequencies, the isolation is mainly due to the increase in electrical separation between antennas 110, 111, the stubs 131, 132; 133, 134 provide a lesser contribution to the overall isolation between antennas.

In this embodiment, the stubs 131, 132; 133, 134 are electrically bonded to the conducting ground plane; again in this embodiment two stubs per monopole are used, but other numbers are envisaged.

It has been found that for many applications a stub length of around λ/4 provides good results. However, stub lengths may be varied and it is not essential that all stubs have identical lengths.

In the second embodiment, the stubs are symmetrically placed. However, in other embodiments, asymmetry may provide improved results depending on the desired performance conditions. It may be necessary to vary the stub disposition to achieve the desired isolation, since it has been found that the placement of the stubs plays a significant role in the antenna-to-antenna isolation. The stubs act as secondary radiators so providing secondary coupling paths from stub to stub and stub to antenna. These secondary paths can be arranged to cancel the primary coupling path that would exist between antennas when the stubs are not present.

In the second embodiment, the ground plane is lengthened by folding it round on itself to increase isolation at lower frequencies. This also necessitates forming a hole in the folded ground plane, so that there is only a single ground plane present under the centre of each monopole.

In the described embodiments of the antenna module, it is remote from the electronics which drives it. In others it is integral with a wideband power transmission amplifier and low-noise receiving amplifier, thus minimising the complexity of installation. The described multi-medium architecture provides increased flexibility. In yet other embodiments, only carrier-modulated signals are carried by the multimode fibre, and digital or baseband signals are carried by a separate antenna feed, for example coaxial cable.

The invention has now been described with regard to some specific examples. The invention is not limited to the described features.

The invention claimed is:

1. A method for facilitating communication between a plurality of external networks and a plurality of user devices, the method comprising:

receiving, by a hub of a distributed antenna system (DAS), a plurality of external network transmission signals representing a plurality of communication services from the plurality of external networks, wherein a first communication service of the plurality of communication services includes a first external network transmission signal of the plurality of external network transmission signals having a first frequency and a second communication service of the plurality of communication services includes a second external network transmission signal of the plurality of external network transmission signals having a second frequency, and wherein the first frequency and the second frequency are at least one GHz apart;

generating, by the hub, a first optical transmission signal based on the first external network transmission signal without frequency conversion of the first external network transmission signal and a second optical transmission signal based on the second external network transmission signal without frequency conversion of the second external network transmission signal;

transmitting, by the hub, the first optical transmission signal and the second optical transmission signal via a transmission path;

receiving, by at least one remote unit of the DAS, the first optical transmission signal and the second optical transmission signal from the transmission path;

converting, by the at least one remote unit, the first optical transmission signal into a first electrical transmission signal and the second optical transmission signal into a second electrical transmission signal;

transmitting, by the at least one remote unit, the first electrical transmission signal to a first device of the plurality of user devices that operates according to the first communication service and the second electrical transmission signal to a second device of the plurality of user devices that operates according to the second communication service;

receiving, by the at least one remote unit, a first electrical reception signal from the first device and a second electrical reception signal from the second device;

converting, by the at least one remote unit, the first electrical reception signal into a first optical reception signal without frequency conversion of the first electrical reception signal and the second electrical reception signal into a second optical reception signal without frequency conversion of the second electrical reception signal;

transmitting, by the at least one remote unit, the first optical reception signal and the second optical reception signal via a reception path;

receiving, by the hub, the first optical reception signal and the second optical reception signal from the reception path;

generating, by the hub, a first external network reception signal based on the first optical reception signal and a second external network reception signal based on the second optical reception signal; and transmitting, by the hub, the first external network reception signal to a first external network of the plurality of external networks and the second external network reception signal to a second external network of the plurality of external networks.

2. The method of claim 1, further comprising:

compensating for frequency-dependent loss in the transmission path with a first compensation device having a plurality of selectable frequency-gain characteristics; and compensating for frequency-dependent loss in the reception path with a second compensation device having a plurality of selectable frequency-gain characteristics.

3. The method of claim 1, further comprising extracting, with a filter, command signals transmitted via the transmission path at a frequency outside of a first frequency band of the first communication service and a second frequency band of the second communication service.

4. The method of claim 3, further comprising:

receiving, by a control device of the at least one remote unit, the extracted command signals; and controlling, by the control device, components of the at least one remote unit based on the extracted command signals.

5. The method of claim 1, further comprising passing any signals between the first frequency and the second frequency through the distributed antenna system without filtering.

6. The method of claim 1, wherein the first frequency and the second frequency are at least an order of magnitude apart.

7. The method of claim 1, wherein a third communication service of the plurality of communication services includes a third external network transmission signal of the plurality of external network transmission signals having a third frequency, wherein the third frequency is a frequency between the first frequency and the second frequency, the method further comprising:

generating, by the hub, a third optical transmission signal based on the third external network transmission signal without frequency conversion of the third external network signal;

transmitting, by the hub, the third optical transmission signal via the transmission path;

receiving, by the at least one remote unit, the third optical transmission signal;

converting, by the at least one remote unit, the third optical transmission signal into a third electrical transmission signal; and transmitting, by the at least one remote unit, the third electrical transmission signal to a third device of the plurality of user devices that operates according to the third communication service.

8. The method of claim 7, further comprising:

receiving, by the at least one remote unit, a third electrical reception signal from the third device;

converting, by the at least one remote unit, the third electrical reception signal into a third optical reception signal without frequency conversion of the third electrical reception signal;

receiving, by the hub, the third optical reception signal via the reception path;

generating, by the hub, a third external network reception signal based on the third optical reception signal; and transmitting, by the hub, the third external network reception signal to a third external network of the plurality of external networks.

9. The method of claim 8, wherein the first optical reception signal, the second optical reception signal and the third optical reception signal are optical analogues of the first electrical reception signal, the second electrical reception signal and the third electrical reception signal.

10. The method of claim 7, wherein the first optical transmission signal, the second optical transmission signal and the third optical transmission signal are optical analogues of the first external network transmission signal, the second external network transmission signal and the third external network transmission signal.

11. The method of claim 1, wherein:

the receiving, by the hub, the plurality of external network transmission signals includes receiving the first external network transmission signal and the second external network transmission signal substantially simultaneously;

the transmitting, by the hub, the first optical transmission signal and the second optical transmission signal includes transmitting the first optical transmission signal and the second optical transmission signal substantially simultaneously;

the receiving, by the at least one remote unit, the first electrical reception signal from the first device and the second electrical reception signal from the second device includes receiving the first electrical reception signal and the second electrical reception signal substantially simultaneously; and the transmitting, by the at least one remote unit, the first optical reception signal and the second optical reception signal includes transmitting the first optical reception signal and the second optical reception signal substantially simultaneously.

12. The method of claim 1, wherein the transmitting, by the at least one remote unit, the first electrical transmission signal to a first device and the second electrical transmission signal to a second device includes transmitting the first electrical transmission signal and the second electrical transmission signal with an amplifier of the at least one remote unit.

13. The method of claim 1, wherein the first frequency and the second frequency are one or more octaves apart.

14. The method of claim 1, wherein:

the generating, by the hub, the first external network reception signal and the second external network reception signal includes converting, by the hub, the first optical reception signal to the first external network reception signal and the second optical reception signal to the second external network reception signal, wherein the first external network reception signal and the second external network reception signal are each electrical signals; and the generating, by the hub, the first optical transmission signal and the second optical transmission signal includes converting, by the hub, the first external network transmission signal to the first optical transmission signal and the second external network transmission signal to the second optical transmission signal, wherein the first external network transmission signal and the second external network transmission signal are each electrical signals.

15. A hub for a distributed antenna system (DAS) that facilitates communication between a plurality of external networks and a plurality of user devices, the hub comprising:

an input terminal configured to receive, from the plurality of external networks, a plurality of external network transmission signals representing a plurality of communication services, wherein a first communication service of the plurality of communication services includes a first external network transmission signal of the plurality of external network transmission signals that includes a first frequency, wherein a second communication service of the plurality of communication services includes a second external network transmission signal of the plurality of external network transmission signals that includes a second frequency, wherein the first frequency and the second frequency are at least 200 MHz apart;

first circuitry configured to generate an optical transmission signal based on the first external network transmission signal and the second external network transmission signal without frequency conversion of the first external network transmission signal and the second external network transmission signal;

a transmission terminal configured to provide the optical transmission signal to a transmission path upon the transmission path being coupled to the transmission terminal, wherein the transmission path is coupled to at least one remote unit, wherein the at least one remote unit is configured to convert the optical transmission signal to a first electrical transmission signal and a second electrical transmission signal and transmit the first electrical transmission signal to a first device of the plurality of user devices that operates according to the first communication service and transmit the second electrical transmission signal to a second device of the plurality of user devices that operates according to the second communication service;

a reception terminal configured to receive an optical reception signal from a reception path upon the reception path being coupled to the reception terminal, wherein the reception path is coupled to the at least one remote unit, wherein the at least one remote unit is configured to receive a first electrical reception signal from the first device and a second electrical reception signal from the second device and generate the optical reception signal based on the first electrical reception signal and the second electrical reception signal without frequency conversion of the first electrical reception signal and the second electrical reception signal;

second circuitry configured to generate a first external network reception signal and a second external network reception signal based on the optical reception signal; and an output terminal configured to provide the first external network reception signal to a first external network of the plurality of external networks and the second external network reception signal to a second external network of the plurality of external networks.

16. The hub of claim 15, wherein the first external network transmission signal and the second external network transmission signal are each electrical signals and wherein the first external network reception signal and the second external network reception signal are each electrical signals.

17. The hub of claim 15, wherein the first frequency and the second frequency are within a frequency range that starts and ends between 130 MHz and 2.7 GHz.

18. The hub of claim 15, wherein the first frequency and the second frequency are one or more octaves apart.

19. The hub of claim 15, wherein the first frequency and the second frequency are at least an order of magnitude apart.

20. The hub of claim 15, wherein the plurality of communication services are each implemented in one of a plurality of different bands between the first frequency and the second frequency.

21. The hub of claim 15, wherein the first frequency and the second frequency are at least one GHz apart.

22. A remote unit for a distributed antenna system (DAS) that facilitates communication between a plurality of external networks and a plurality of user devices, the remote unit comprising:

a transmission terminal configured to receive an optical transmission signal from a transmission path upon the transmission path being coupled to the transmission terminal, wherein the transmission path is coupled to a hub, wherein the hub is configured to receive, from the plurality of external networks, a plurality of external network transmission signals representing a plurality of communication services, wherein a first communication service of the plurality of communication services includes a first external network transmission signal of the plurality of external network transmission signals that includes a first frequency, wherein a second communication service of the plurality of communication services includes a second external network transmission signal of the plurality of external network transmission signals that includes a second frequency, wherein the first frequency and the second frequency are at least 200 MHz apart, wherein the hub is configured to generate the optical transmission signal based on the first external network transmission signal and the second external network transmission signal without frequency conversion of the first external network transmission signal and the second external network transmission signal;

first circuitry configured to generate a first electrical transmission signal and a second electrical transmission signal based on the optical transmission signal;

an amplifier configured to provide the first electrical transmission signal to an output terminal for transmission to a first device of the plurality of user devices that operates according to the first communication service and to provide the second electrical transmission signal to the output terminal for transmission to a second device of the plurality of user devices that operates according to the second communication service;

an input terminal configured to receive a first electrical reception signal from the first device and a second electrical reception signal from the second device;

second circuitry configured to generate an optical reception signal based on the first electrical reception signal and the second electrical reception signal without frequency conversion of the first electrical reception signal and the second electrical reception signal; and a reception terminal configured to provide the optical reception signal to a reception path upon the reception path being coupled to the reception terminal, wherein the reception path is coupled to the hub, the hub configured to generate a first external network reception signal and a second external network reception signal based on the optical reception signal and provide the first external network reception signal to a first external network of the plurality of external networks and the second external network reception signal to a second external network of the plurality of external networks.

23. The remote unit of claim 22, wherein the amplifier has high linearity for any frequency between the first frequency and the second frequency.

24. The remote unit of claim 22, wherein the first frequency and the second frequency are one or more octaves apart.

25. The remote unit of claim 22, wherein the amplifier comprises one of a power amplifier or an intermediate chain amplifier.

26. The remote unit of claim 22, wherein the amplifier has an average OIP2 of 50 dBm or 70 dBm.

27. The remote unit of claim 22, wherein the first frequency and the second frequency are at least an order of magnitude apart.

28. A method for facilitating communications through a distributed antenna system (DAS), the method comprising:

receiving, by at least one remote unit of the DAS, a first reception signal from a first device of a plurality of user devices that operates according to a first communication service of a plurality of communication services and a second reception signal from a second device of the plurality of user devices that operates according to a second communication service of the plurality of communication services;

providing, by the at least one remote unit, an optical reception signal based on the first reception signal and the second reception signal to a reception path without frequency conversion of the first reception signal and the second reception signal;

receiving, by a hub of the DAS, the optical reception signal from the reception path;

providing, by the hub, a first external network reception signal based on the optical reception signal to a first external network of a plurality of external networks and a second external network reception signal based on the optical reception signal to a second external network of the plurality of external networks;

receiving, by the hub, a first external network transmission signal having a first frequency and a second external network transmission signal having a second frequency from the plurality of external networks, wherein the first frequency and the second frequency are at least 200 MHz apart, and wherein the first external network transmission signal represents the first communication service and the second external network transmission signal represents the second communication service;

providing, by the hub, an optical transmission signal based on the first external network transmission signal and the second external network transmission signal without frequency conversion of the first external network transmission signal and the second external network transmission signal to a transmission path;

receiving, by the at least one remote unit, the optical transmission signal from the transmission path; and providing, by the at least one remote unit, a first transmission signal based on the optical transmission signal to the first device and a second transmission signal based on the optical transmission signal to a second device.

29. The method of claim 28, further comprising:

converting, by the at least one remote unit, the optical transmission signal to the first transmission signal and the second transmission signal, wherein the first transmission signal and the second transmission signal are electrical signals;

converting, by the at least one remote unit, the first reception signal and the second reception signal to the optical reception signal, wherein the first reception signal and the second reception signal are electrical signals;

converting, by the hub, the first external network transmission signal and the second external network transmission signal to the optical transmission signal, wherein the first external network transmission signal and the second external network transmission signal are electrical signals; and converting, by the hub, the optical reception signal to the first external network reception signal and the second external network reception signal, wherein the first external network reception signal and the second external network reception signal are electrical signals.

30. The method of claim 28, wherein:

the receiving, by the hub, the first external network transmission signal and the second external network transmission signal includes receiving the first external network transmission signal and the second external network transmission signal substantially simultaneously; and the receiving, by the at least one remote unit, the first reception signal and the second reception signal includes receiving the first reception signal and the second reception signal substantially simultaneously.

31. A method for facilitating communication between a plurality of external networks and a plurality of user devices, the method comprising:

receiving, by a hub of a distributed antenna system (DAS), a plurality of external network transmission signals representing a plurality of communication services from the plurality of external networks, wherein a first communication service of the plurality of communication services includes a first external network transmission signal of the plurality of external network transmission signals having a first frequency and a second communication service of the plurality of communication services includes a second external network transmission signal of the plurality of external network transmission signals having a second frequency, and wherein the first frequency and the second frequency are at least 200 MHz apart;

generating, by the hub, an optical transmission signal based on the first external network transmission signal and the second external network transmission signal without frequency conversion of the first external network transmission signal and the second external network transmission signal;

transmitting, by the hub, the optical transmission signal via a transmission path;

receiving, by at least one remote unit of the DAS, the optical transmission signal from the transmission path;

converting, by the at least one remote unit, the optical transmission signal into a first electrical transmission signal and a second electrical transmission signal;

transmitting, by the at least one remote unit, the first electrical transmission signal to a first device of the plurality of user devices that operates according to the first communication service and the second electrical transmission signal to a second device of the plurality of user devices that operates according to the second communication service;

receiving, by the at least one remote unit, a first electrical reception signal from the first device and a second electrical reception signal from the second device;

converting, by the at least one remote unit, the first electrical reception signal and the second electrical reception signal into an optical reception signal without frequency conversion of the first electrical reception signal and the second electrical reception signal;

transmitting, by the at least one remote unit, the optical reception signal via a reception path;

receiving, by the hub, the optical reception signal from the reception path;

generating, by the hub, a first external network reception signal and a second external network reception signal based on the optical reception signal; and transmitting, by the hub, the first external network reception signal to a first external network of the plurality of external networks and the second external network reception signal to a second external network of the plurality of external networks.

* * * * *